US011994315B2

(12) United States Patent
Oishi et al.

(10) Patent No.: US 11,994,315 B2
(45) Date of Patent: May 28, 2024

(54) AIR-CONDITIONING APPARATUS

(71) Applicant: Mitsubishi Electric Corporation, Tokyo (JP)

(72) Inventors: Masayuki Oishi, Tokyo (JP); Hiroshi Hirosaki, Tokyo (JP); Yohei Koyanagi, Tokyo (JP); Kazuki Nagai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 388 days.

(21) Appl. No.: 17/610,775

(22) PCT Filed: Aug. 8, 2019

(86) PCT No.: PCT/JP2019/031389
§ 371 (c)(1),
(2) Date: Nov. 22, 2021

(87) PCT Pub. No.: WO2021/024458
PCT Pub. Date: Feb. 11, 2021

(65) Prior Publication Data

US 2022/0307724 A1 Sep. 29, 2022

(51) Int. Cl.
*F24F 13/20* (2006.01)
*F24F 11/89* (2018.01)
*F24F 110/10* (2018.01)

(52) U.S. Cl.
CPC ..... *F24F 13/20* (2013.01); *F24F 11/89* (2018.01); *F24F 2110/10* (2018.01)

(58) Field of Classification Search
CPC .... F24F 3/20; F24F 11/70; F24F 11/89; F24F 2120/00; F24F 2120/12; F24F 1/0057
See application file for complete search history.

(56) References Cited

U.S. PATENT DOCUMENTS 5,372,545 A * 12/1994 Noda ..... F24F 11/64 236/51
2010/0063636 A1* 3/2010 Matsumoto ..... F24F 11/63 700/276

(Continued)

FOREIGN PATENT DOCUMENTS

JP 2012-042184 A 3/2012
JP 2017-044439 A 3/2017

OTHER PUBLICATIONS

International Search Report dated Oct. 8, 2019, issued in corresponding International Application No. PCT/JP2019/031389 (and English Machine Translation).

*Primary Examiner* — Marc E Norman
(74) *Attorney, Agent, or Firm* — POSZ LAW GROUP, PLC

(57) ABSTRACT

An air-conditioning apparatus includes a heat-source detection unit provided at the front of a housing. The heat-source detection unit includes an infrared sensor that detects a heat source in an air-conditioned space and a supporting member that supports the infrared sensor. The supporting member is rotated about an axis that extends in a vertical direction. Part of the infrared sensor that corresponds to the field of view thereof is exposed when the infrared sensor faces the air-conditioned space, and the part of the infrared sensor is concealed when the infrared sensor does not face the air-conditioned space.

5 Claims, 19 Drawing Sheets

(56) References Cited

U.S. PATENT DOCUMENTS

| | | | | |
|---|---|---|---|---|
| 2013/0099124 | A1* | 4/2013 | Filson | F24F 11/00 250/353 |
| 2014/0374083 | A1* | 12/2014 | Lee | F24F 11/46 236/51 |
| 2015/0377503 | A1* | 12/2015 | Nakamoto | F24F 11/79 62/176.1 |
| 2016/0356518 | A1* | 12/2016 | Kurachi | F24F 1/0014 |
| 2017/0336082 | A1* | 11/2017 | Kamijo | F24F 11/52 |
| 2018/0100667 | A1* | 4/2018 | Komae | F24F 8/80 |
| 2020/0217550 | A1* | 7/2020 | Boyd | F24F 11/74 |

* cited by examiner

41

42

(a)

(b)

(a)

(b)

AIR-CONDITIONING APPARATUS

CROSS REFERENCE TO RELATED APPLICATION

This application is a U.S. National Stage Application of International Application No. PCT/JP2019/031389, filed on Aug. 8, 2019, the contents of which are incorporated herein by reference.

TECHNICAL FIELD

The present disclosure relates to an air-conditioning apparatus provided with a sensor that detects a heat source.

BACKGROUND ART

In the past, air-conditioning apparatuses provided with a sensor that detects a heat source in an air-conditioned space have been known. For example, an air-conditioning apparatus described in Patent Literature 1 is provided with an infrared sensor located at the front of a housing of the air-conditioning apparatus, and detects, using the infrared sensor, the temperature of a human body that is a heat source and the temperatures of, for example, a floor surface and a wall surface in a room.

CITATION LIST

Patent Literature

Patent Literature 1: Japanese Unexamined Patent Application Publication No. 2017-44439

SUMMARY OF INVENTION

Technical Problem

In recent years, it has been required to detect not only the position and the temperature of a heat source but also a stream of air, in order to achieve an air-conditioning control for a better comfort. In the stream of air, a temperature change of the air is minute. Therefore, in order to detect a stream of air, it is necessary to use a high-precision and high resolution sensor, that is, an infrared sensor that is highly sensitive, as compared with existing sensors. Of such kinds of infrared sensors, a given kind of infrared sensor itself generates heat. In this kind of infrared sensor, detection of the temperature of an air-conditioned space may be affected by the heat generated by the sensor itself. Therefore, when being used, such a highly sensitive infrared sensor is required to detect the temperature of an air-conditioned space in consideration of the heat generated by the sensor itself.

The present disclosure is applied to solve the above problem, and relates to an air-conditioning apparatus in which the versatility of temperature detection is improved such that detection using characteristics of a sensor that detects the temperature of a heat source in an air-conditioned space can be performed.

Solution to Problem

An air-conditioning apparatus of an embodiment of the present disclosure includes a heat-source detection unit provided at a front of a housing. The heat-source detection unit includes an infrared sensor that detects a heat source in an air-conditioned space, and a supporting member that supports the infrared sensor. The supporting member is configured to be rotated about an axis that extends in a vertical direction. Part of the infrared sensor that corresponds to the field of view thereof is exposed, when the infrared sensor faces the air-conditioned space, and the part of the infrared sensor is concealed when the infrared sensor does not face the air-conditioned space.

Advantageous Effects of Invention

The air-conditioning apparatus according to the embodiment of the present disclosure is capable of detecting the temperature of the heat source in the air-conditioned space, with the part of the infrared sensor that corresponds to the field of view thereof exposed; and is capable of detecting the temperature of heat that is generated by the infrared sensor itself, with the above part of the infrared sensor concealed. Thus, the temperature that is detected, with the above part of the infrared sensor exposed, can be compensated for based on the temperature that is detected, with the above part of the infrared sensor concealed. That is, even when an infrared sensor that generates heat from the body of the sensor is used, it is possible to perform detection utilizing such characteristics of the sensor. Thus, according to the present disclosure, the air-conditioning apparatus can be improved in versatility of temperature detection.

DESCRIPTION OF EMBODIMENTS

Embodiments of an air-conditioning apparatus according to the present disclosure will be described with reference to the drawings. The descriptions concerning the embodiments are not limiting, and various modifications can be made without departing from the gist of the present disclosure. In addition, the present disclosure covers all combinations of configurations that can be combined with respect to configurations that will be described regarding the embodiments. In addition, an air-conditioning apparatus as illustrated in each of the accompanying figures is merely an example of an apparatus to which the air-conditioning apparatus according to the present disclosure is applied. In the descriptions concerning the embodiments, in order that the embodiments be easily understood, terms related to directions (such as "upper", "lower", "right", "left", front", and "rear") are used as appropriate; however, these terms are used only for explanation, that is, they do not limit the embodiments. In each of the figures, components that are the same as or equivalent to those in a previous or previous figures are denoted by the same reference sins, and the same is true of the entire text of the specification. It should be noted that in the figures, for example, relationships in dimension between components or the shapes of the components may differ from actual ones.

Embodiment 1

Figure 1:
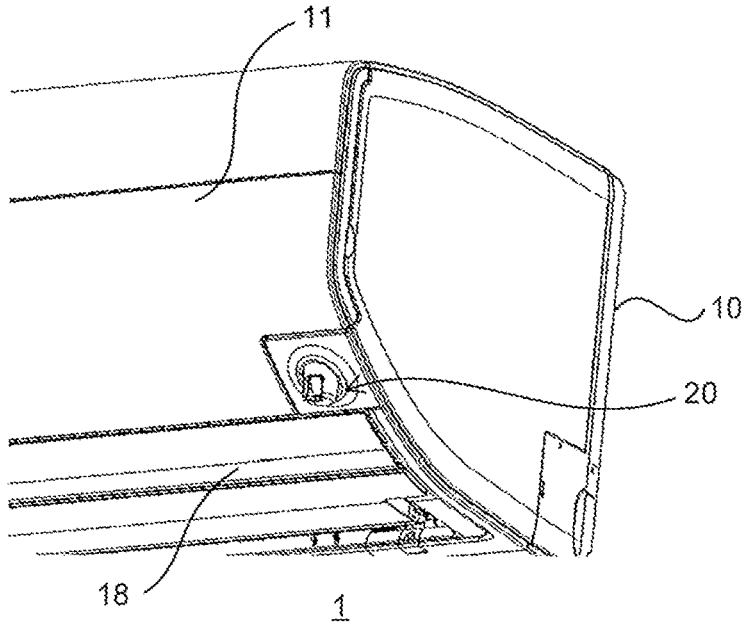
FIG. 1 is a perspective view of part of an air-conditioning apparatus according to Embodiment 1.
Figure 2:
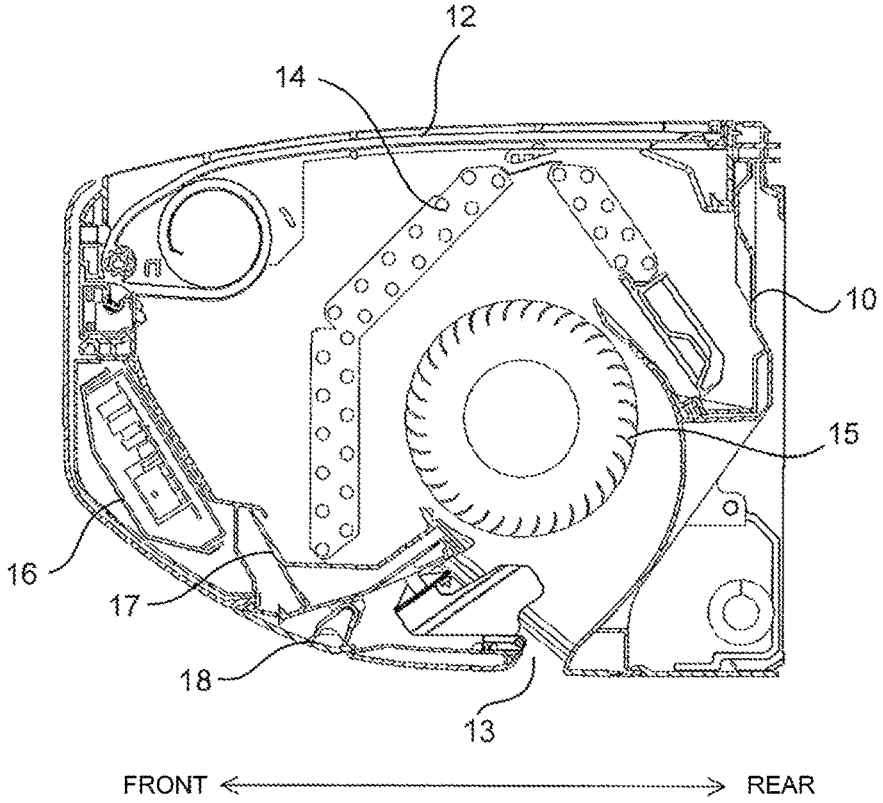
FIG. 2 is a sectional view of the air-conditioning apparatus according to Embodiment 1.

FIG. 1 is a perspective view of part of an air-conditioning apparatus according to Embodiment 1. FIG. 2 is a sectional view of the air-conditioning apparatus according to Embodiment 1. FIG. 1 illustrates a front portion and a right side portion of an air-conditioning apparatus 1 as viewed in a direction toward the front of the air-conditioning apparatus 1. FIG. 2 is a sectional view of the air-conditioning apparatus 1 that is taken along a central line, from a central portion of the air-conditioning apparatus 1 in a lateral direction thereof, as viewed from a right side of the air-conditioning apparatus 1. The left side of FIG. 2 is the front side of the air-conditioning apparatus 1, and the right side of FIG. 2 is the rear side of the air-conditioning apparatus 1. The air-conditioning apparatus 1 is an indoor unit that supplies air subjected to an air-conditioning control into an air-conditioned space such as an indoor space, using a refrigeration cycle through which refrigerant circulates.

The air-conditioning apparatus 1 includes a rear case 10 on the rear side and a design panel 11 on the front side. In the top of the air-conditioning apparatus 1, air inlet 12 is formed. Between the rear case 10 and the design panel 11, an air outlet 13 is formed. In the rear case 10, a heat exchanger 14, a fan 15, and an electric component assembly 16 are provided. In addition, below the heat exchanger 14, a drain pan 17 is provided to receive dew condensation water from the heat exchanger 14. At the air outlet 13, a wind-direction adjustment plate 18 is provided.

When the fan 15 is driven, indoor air is sucked from the air inlet 12. The sucked air exchanges heat with refrigerant at the heat exchanger 14 to change into cold air or warm air. The wind-direction adjustment plate 18 determines the direction where the cold air or the warm air is to be blown out, and the cold air or the warm air is blown into the indoor space from the air outlet 13.

As illustrated in FIG. 1, a heat-source detection unit 20 is provided at a right end portion of the front of the air-conditioning apparatus 1. The heat-source detection unit 20 detects the temperature of a heat source in a room interior that is an air-conditioned space. The heat-source detection unit 20 is provided above the wind-direction adjustment plate 18. Thus, the cold air or the warm air blown out form the air outlet 13 does not directly hit the heat-source detection unit 20.

Figure 3:
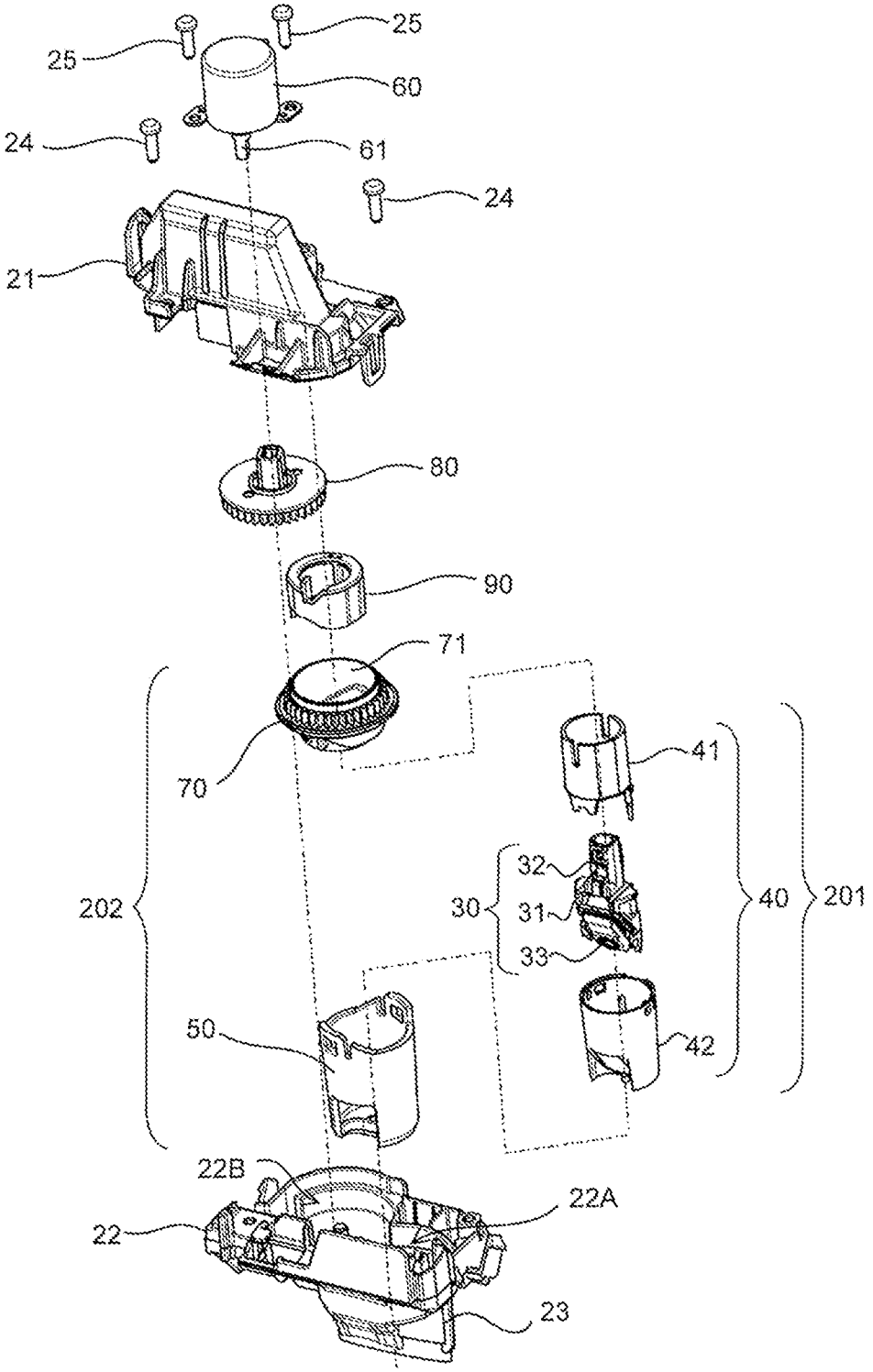
FIG. 3 is an exploded perspective view of a heat-source detection unit of the air-conditioning apparatus according to Embodiment 1.

FIG. 3 is an exploded perspective view of the heat-source detection unit of the air-conditioning apparatus according to Embodiment 1, As illustrated in FIG. 3, the heat-source detection unit 20 includes an upper base 21, a lower base 22, a sensor-supporting body 201, and a cover assembly 202. The sensor-supporting body 201 includes a sensor portion 30 and a supporting member 40. The cover assembly 202 includes a first gear member 70 and a cover member 50. The heat-source detection unit 20 further includes a motor 60, a second gear member 80, and a coupling member 90.

The lower base 22 is provided below the upper base 21, and the upper base 21 and the lower base 22 are fixed to each other by a screw 24. The motor 60 is provided such that a motor shaft 61 faces downward. The motor 60 is fixed to an upper surface of the upper base 21 by screws 25.

The sensor portion 30 includes a sensor substrate 31 and a substrate holder 32. On the sensor substrate 31, an infrared sensor 33 is mounted. The infrared sensor 33 is a high precision and high resolution infrared sensor. This infrared sensor itself generates heat. That is, the infrared sensor 33 is an infrared sensor that senses such self-heating. The sensor substrate 31 is supported by the substrate holder 32.

The supporting member 40 includes an upper frame 41 having a hollow cylindrical shape and a lower frame 42 having a hollow cylindrical shape. The lower frame 42 is fixed to a lower portion of the upper frame 41. The inside diameter of the lower frame 42 is substantially equal to the outside diameter of the upper frame 41. Thus, an upper end face of the lower frame 42 is located outside the upper frame 41.

Figure 4:
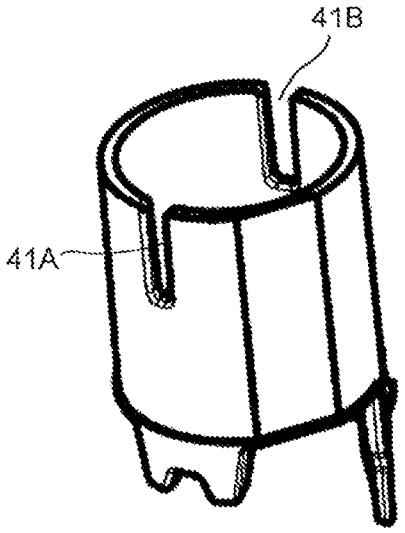
FIG. 4 is an enlarged perspective view of an upper frame of a supporting member of the heat-source detection unit.
Figure 5:
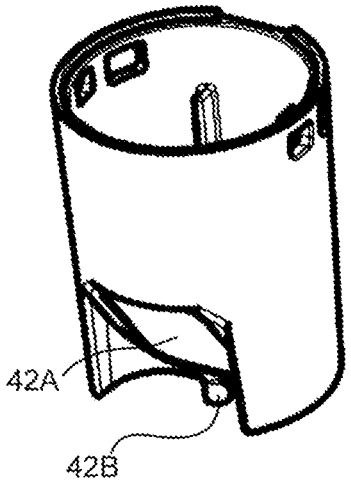
FIG. 5 is an enlarged perspective view of a lower frame of the supporting member of the heat-source detection unit.

FIG. 4 is an enlarged perspective view of the upper frame of the supporting member of the heat-source detection unit. FIG. 5 is an enlarged perspective view of the lower frame of the supporting member of the heat-source detection unit. As illustrated in FIG. 4, in an upper portion of the upper frame 41, slits 41A and 41B are formed. As illustrated in FIG. 5, in a lower portion of the lower frame 42, a window 42A is formed. At a bottom surface of the lower frame 42, a protrusion 42B is provided in such a manner as to protrude downward. The lower frame 42 is made of material that allows infrared rays to pass therethrough. The above sensor portion 30 is supported in the supporting member 40 such that the infrared sensor 33 on the sensor substrate 31 is positioned to face the window 42A.

Figure 6:
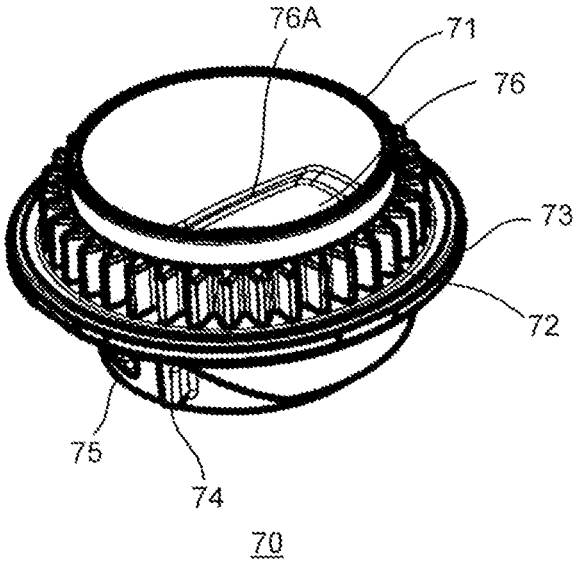
FIG. 6 is an enlarged perspective view of a first gear member of the heat-source detection unit.

FIG. 6 is an enlarged perspective view of the first gear member of the heat-source detection unit. The first gear member 70 includes a hollow cylindrical portion 71, a spur gear portion 72, a flange 73, a linear protrusion 74, a rectangular protrusion 75, and an engagement portion 76.

The spur gear portion 72 is provided at the entire outer circumference of the hollow cylindrical portion 71 in a circumferential direction thereof. The flange 73 is provided at the outer circumference of the hollow cylindrical portion 71 and located below the spur gear portion 72.

The linear protrusion 74 and the rectangular protrusion 75 are provided at the outer circumference of the hollow cylindrical portion 71 and located below the flange 73. The linear protrusion 74 has a vertically elongated shape. The rectangular protrusion 75 has a substantially rectangular shape. The linear protrusion 74 and the rectangular protrusion 75 are located close to each other in the circumferential direction of the hollow cylindrical portion 71. A linear protrusion having a vertically elongated shape that is similar to that of the linear protrusion 74 is provided opposite to the linear protrusion 74 with respect to the axial of the hollow cylindrical portion 71. A rectangular protrusion having a substantially rectangular shape that is similar to that of the rectangular protrusion 75 is provided opposite to the rectangular protrusion 75 with respect to the axis of the hollow cylindrical portion 71.

The engagement portion 76 is provided on an inner surface of the hollow cylindrical portion 71. The engagement portion 76 is formed in the shape of a wall that protrudes toward the axis of the hollow cylindrical portion 71. At an upper end face of the engagement portion 76, a first inclined surface 76A is formed in such a manner as to be inclined downward or upward in the circumferential direction. An engagement portion that is similar to the engagement portion 76 is provided opposite to the engagement portion 76 with respect to the axis of the hollow cylindrical portion 71.

Figure 7:
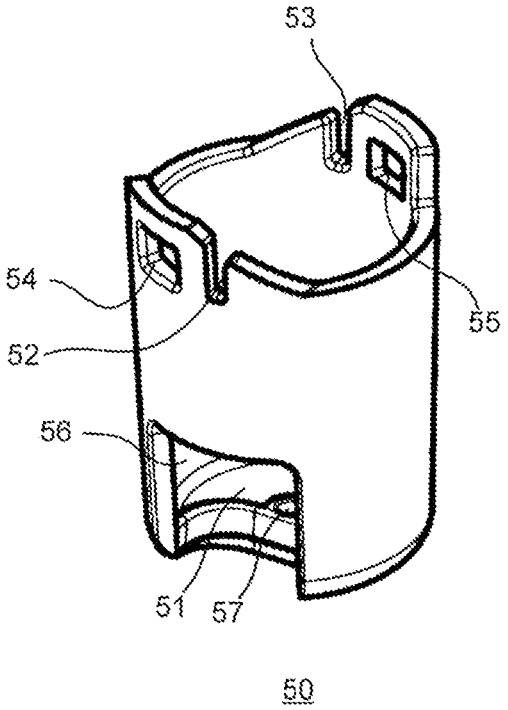
FIG. 7 is an enlarged perspective view of a cover member of the heat-source detection unit.

FIG. 7 is an enlarged perspective view of the cover member of the heat-source detection unit. The cover member 50 is made of material that does not allow infrared rays to pass therethrough. The cover member 50 has a hollow cylindrical shape and has a bottom surface 51. In an upper portion of the cover member 50, engagement slits 52 and 53 and engagement holes 54 and 55 are formed. In a lower portion of the cover member 50, an opening 56 is formed. A hollow reception portion 57 is provided at the bottom surface 51 and located at a position where the axis of the cover member 50 intersects the bottom surface 51.

The first gear member 70 is attached to the upper portion of the cover member 50. The linear protrusion 74 of the first gear member 70 is engaged with the engagement slit 52 of the cover member 50. The above protrusion that is formed at the first gear member 70 and located opposite to the linear protrusion 74 with respect to the axis of the hollow cylindrical portion 71 is engaged with the engagement slit 53. The rectangular protrusion 75 of the first gear member 70 is engaged with the engagement hole 54 of the cover member 50. The above protrusion that is formed at the first gear member 70 and located opposite to the rectangular protrusion 75 with respect to the axial of the hollow cylindrical portion 71 is engaged with the engagement hole 55. By virtue of the above configuration, when a rotational force is applied to the first gear member 70 in a direction around the axis thereof, the cover member 50 is rotated in synchronization with the motor 60 as illustrated in FIG. 3.

Figure 8:
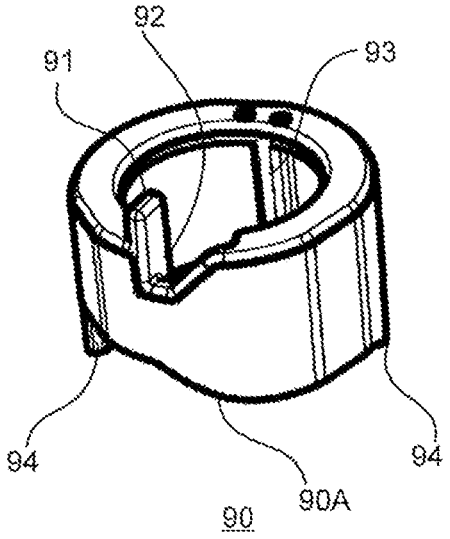
FIG. 8 is an enlarged perspective view of a coupling member of the heat-source detection unit.

FIG. 8 is an enlarged perspective view of the coupling member of the heat-source detection unit. The coupling member 90 has a hollow cylindrical shape. In an upper end face of the coupling member 90, a stopper 91 is provided in such a manner to protrude upward. At least part of a lower portion of the coupling member 90 is cut out in the circumferential direction. That is, at a lower end face of the coupling member 90, a second inclined surface 90A is formed in such a manner as to be inclined downward or upward in the circumferential direction. Another second inclined surface 90A similar to the above second inclined surface 90A is formed opposite to the above second inclined surface 90A with respect to the axis of the coupling member 90. At an inner surface of the coupling member 90, linear protrusions 92 and 93 are provided. Each of the linear protrusions 92 and 93 has a vertically elongated shape. The stopper 91 and the linear protrusion 92 are formed integral with each other. In addition, a rotation-restricting protrusion 94 to restrict the rotation of the first gear member 70 is provided at the lower portion of the coupling member 90. The rotation-restricting protrusion 94 will be described later.

Re-referring to FIG. 3, the outside diameter of the upper frame 41 of the supporting member 40 is smaller than the inside diameter of the hollow cylindrical portion 71 of the first gear member 70, and the upper frame 41 is inserted into the hollow cylindrical portion 71 from below. The outside diameter of the coupling member 90 is smaller than the inside diameter of the hollow cylindrical portion 71 of the first gear member 70, and the coupling member 90 is inserted into the hollow cylindrical portion 71 from above.

The sensor-supporting body 201, the cover assembly 202, and the coupling member 90 are provided at a first installation portion 22A of the lower base 22, with the above portions of the sensor-supporting body 201, the cover assembly 202, and the coupling member 90 attached as described above.

In Embodiment 1, the first gear member 70, the second gear member 80, and the coupling member 90 each serve as a transmission unit that transmits a rotational motion of the motor 60.

<Viewing Angle of Infrared Sensor and Opening of Cover Member>

Figure 9:
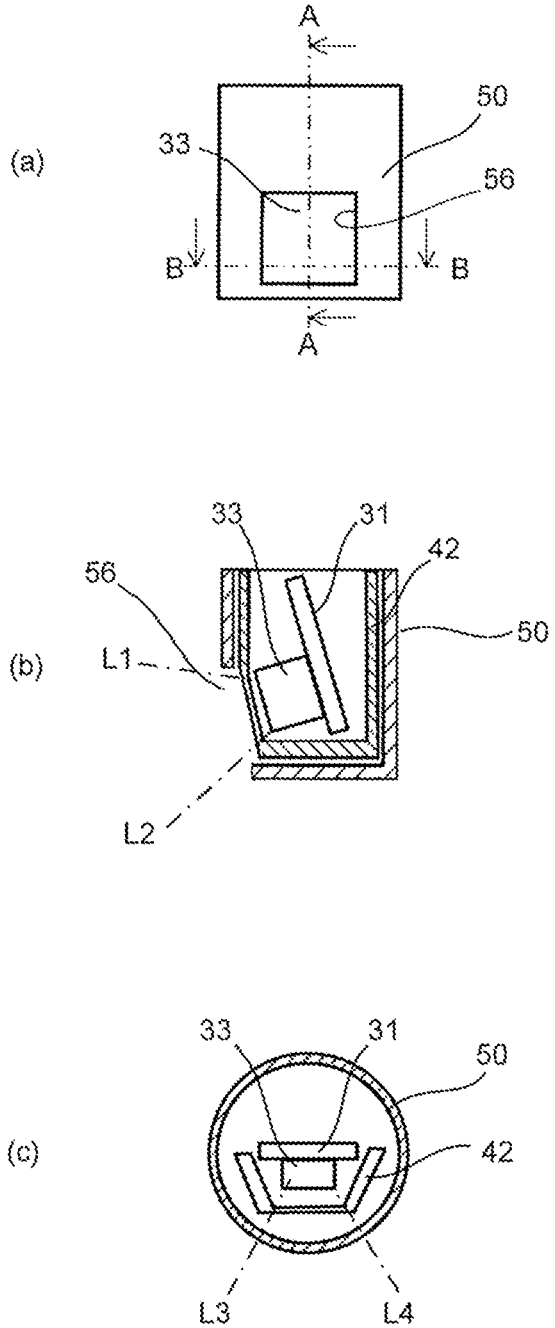
FIG. 9 is a schematic view illustrating the viewing angle of an infrared sensor of the air-conditioning apparatus according to Embodiment 1.

FIG. 9 is a schematic view illustrating a viewing angle of the infrared sensor of the air-conditioning apparatus according to Embodiment 1. FIG. 9 is a schematic view conceptually illustrating a positional relationship between the lower frame 42 of the supporting member 40, the sensor substrate 31 of the sensor portion 30, and the cover member 50. FIG. 9 illustrates how the infrared sensor 33 on the sensor substrate 31 is positioned to face the opening 56 of the cover member 50. FIG. 9, (a), is a front view of the cover member 50; FIG. 9, (b), is a sectional view taken along line A-A in FIG. 9, (a); and FIG. 9, (c), is a sectional view taken along line B-B in FIG. 9, (a). The infrared sensor 33 has a viewing angle between dash-dot-dash line L1 and dash-dot-dash line L2 in the vertical direction as indicated in FIG. 9, (b). The infrared sensor 33 has a viewing angle between dash-dot-dash line L3 and dash-dot-dash line L4 in the lateral direction as indicated in FIG. 9, (c). The opening 56 of the cover member 50 is provided such that the cover member 50 does not conceal part of the infrared sensor 33 that corresponds to the viewing angles of the infrared sensor 33 in the lateral direction and the vertical direction.

<Sensor-Supporting Body and Cover Assembly>

Figure 10:
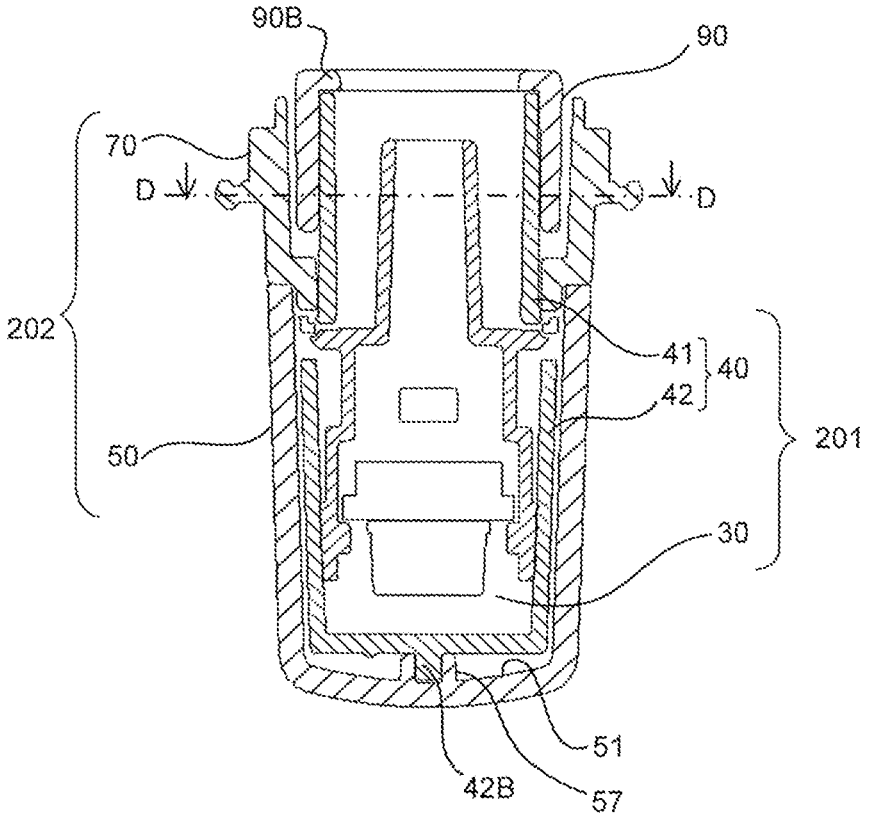
FIG. 10 is a sectional view of a sensor-supporting body and a cover assembly of the heat-source detection unit according to Embodiment 1.

FIG. 10 is a sectional view of the sensor-supporting body and the cover assembly of the heat-source detection unit according to Embodiment 1. To be more specific, FIG. 10 is a sectional view taken along a plane that is parallel to the lateral direction of the air-conditioning apparatus 1 and that includes the axis of the cover member 50 of the cover assembly 202, and illustrates the sensor-supporting body 201, the cover assembly 202, and the coupling member 90 of the heat-source detection unit 20, as viewed in the direction toward the front of the air-conditioning apparatus 1.

The first gear member 70 is mounted on an upper end face of the cover member 50. As described above, the linear protrusion 74 of the first gear member 70 as illustrated in FIG. 6 is fitted in the engagement slit 53 of the cover member 50 as illustrated in FIG. 7, and the rectangular protrusion 75 of the first gear member 70 as illustrated in FIG. 6 is fitted in the engagement hole 54 of the cover member 50 as illustrated in FIG. 7. Thus, a rotational motion of the motor 60 that is transmitted to the first gear member 70 via the second gear member 80 is transmitted to the cover member 50. That is, when the motor 60 is rotated, the first gear member 70 and the cover member 50 are also rotated.

The outside diameter of the lower frame 42 of the supporting member 40 is smaller than the inside diameter of the cover member 50, and the lower frame 42 is inserted into the cover member 50 from above. The protrusion 42B of the lower frame 42 is inserted in the reception portion 57 of the bottom surface 51 of the cover member 50 such that the protrusion 423 is slidable about the axis of the supporting member 40. That is, the supporting member 40 can be rotated independently of the first gear member 70 and the cover member 50.

The coupling member 90 is provided between the upper frame 41 of the supporting member 40 and the first gear member 70. At an upper end portion of the coupling member 90, a flange 903 is provided in such a manner as to extend toward the axis of the coupling member 90. The flange 90B is provided at the entire circumference of the coupling member 90 in the circumferential direction. The flange 90B of the coupling member 90 is in contact with an upper end face of the upper frame 41, and the coupling member 90 is supported by the upper frame 41.

<Mounting of Second Gear Member and Cover Assembly>

Figure 11:
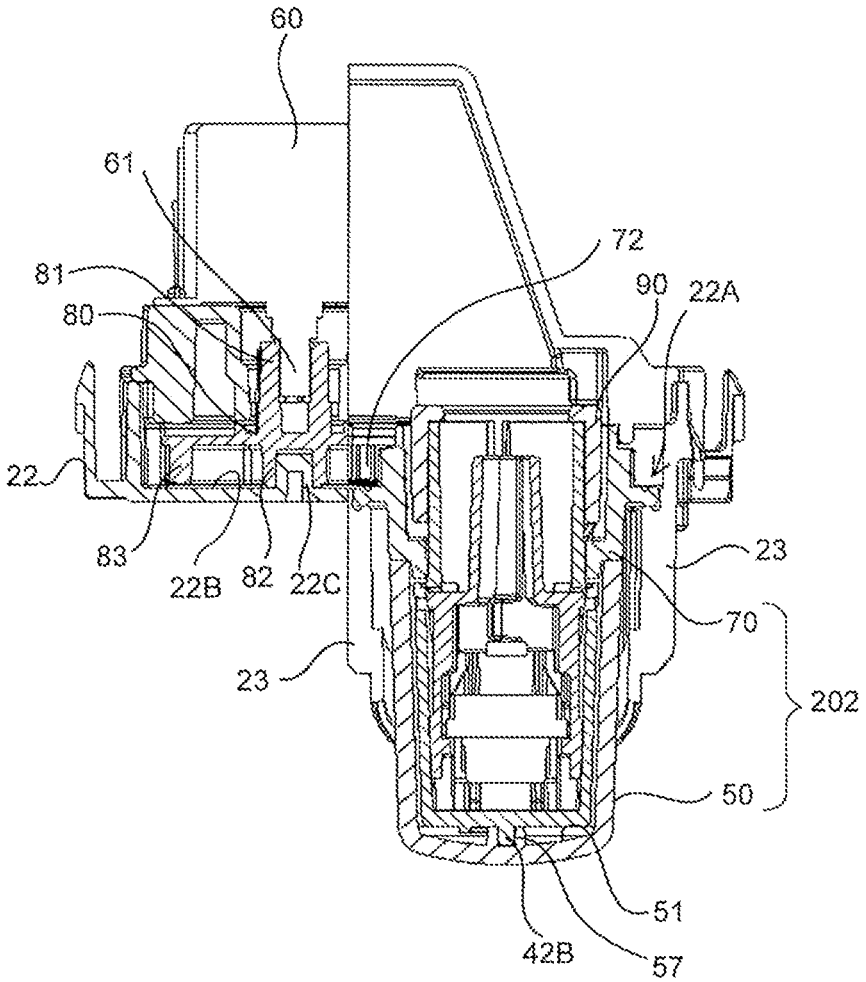
FIG. 11 is a sectional view of the heat-source detection unit of the air-conditioning apparatus according to Embodiment 1.

FIG. 11 is a sectional view of the heat-source detection unit of the air-conditioning apparatus according to Embodiment 1. To be more specific, FIG. 11 is a sectional view of the heat-source detection unit 20 that is taken along line C-C in FIG. 14, as viewed in a direction indicated by arrows in FIG. 14 which will be referred to later. The second gear member 80 includes an upper bearing 81, a lower bearing 82, and a spur gear portion 83. The upper bearing 81 extends upward at the axis of the second gear member 80. The lower bearing 82 extends downward at the axis of the second gear member 80. The upper bearing 81 is formed coaxially with the lower bearing 82. The second gear member 80 is provided at a second installation portion 22B of the lower base 22. At a bottom surface of the second installation portion 228, a protrusion 22C is formed. The lower bearing 82 is fitted onto the protrusion 22C such that the lower bearing 82 can be rotated about the axis of the protrusion 22C. The motor shaft 61 of the motor 60 is inserted in the upper bearing 81 of the second gear member 80. The upper bearing 81 has a rectangular cross section. Thus, when the motor 60 is rotated, the second gear member 80 is also rotated in synchronization with the motor 60.

A hollow sleeve 23 is provided on a lower surface of the first installation portion 22A of the lower base 22, and extends downward. The cover assembly 202 is provided at the first installation portion 22A of the lower base 22. The cover assembly 202 is inserted in the sleeve 23. A lower portion of the cover assembly 202 is exposed from a bottom portion of the sleeve 23. A lower end face of the flange 73 of the first gear member 70 is in contact with an upper end face of the sleeve 23, and the first gear member 70 is mounted on the sleeve 23. That is, the cover assembly 202 is mounted on the lower base 22, and the downward movement of the cover assembly 202 is restricted.

The spur gear portion 72 of the first gear member 70 of the cover assembly 202 meshes with the spur gear portion 83 (see FIG. 3) of the second gear member 80. Thus, when the motor 60 is rotated, the rotational force of the motor 60 is transmitted to the first gear member 70 via the second gear member 80.

<Engagement Between Coupling Member and Upper Frame>

Figure 12:
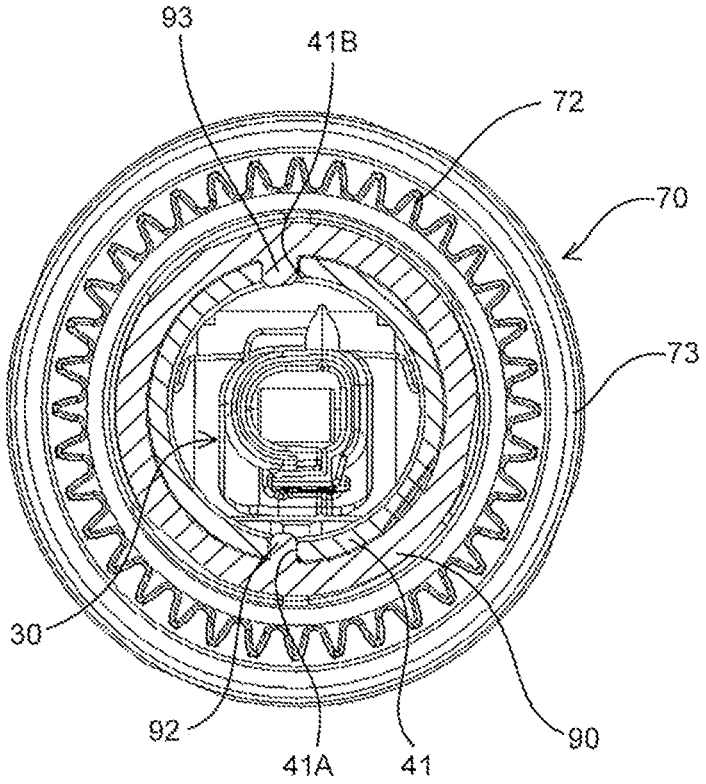
FIG. 12 is a sectional view taken along line D-D in FIG. 10.

FIG. 12 is a sectional view taken along line D-D in FIG. 10. As described above, the coupling member 90 is attached to the upper portion of the upper frame 41. The linear protrusion 92 of the coupling member 90 is engaged with the slit 41A of the upper frame 41, and the linear protrusion 93 of the coupling member 90 is engaged with the slit 41B of the upper frame 41. Thus, the coupling member 90 and the upper frame 41 are rotated about the axis in synchronization with each other. In addition, as described above, in the supporting member 40, the lower frame 42 is fixed to the upper frame 41. Thus, when the coupling member 90 is rotated, the entire supporting member 40 is rotated along with the coupling member 90.

<Engagement Between First Gear Member and Coupling Member>

Figure 13:
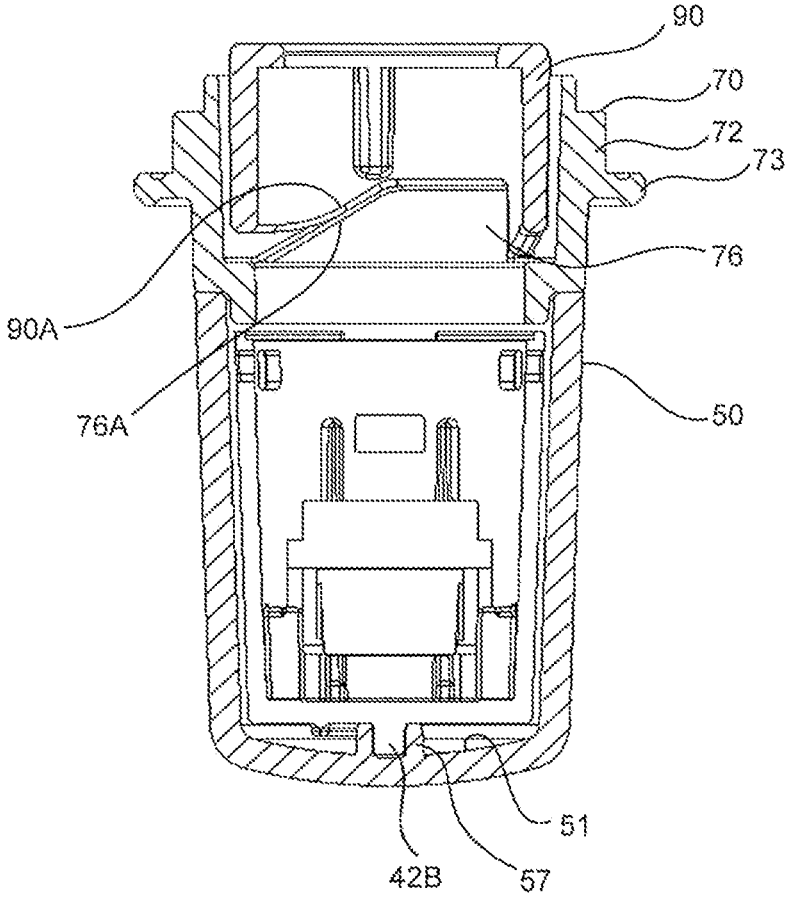
FIG. 13 is a sectional view of the sensor-supporting body and the cover assembly of the heat-source detection unit according to Embodiment 1.

FIG. 13 is a sectional view of the sensor-supporting body and the cover assembly of the heat-source detection unit according to Embodiment 1. To be more specific, FIG. 13, as well as FIG. 10, is a sectional view taken along a plane that is parallel to the lateral direction of the air-conditioning apparatus 1 and that includes the axis of the cover member 50 of the cover assembly 202, and illustrates the sensor-supporting body 201, the cover assembly 202, and the coupling member 90 of the heat-source detection unit 20, as viewed in the direction toward the front of the air-conditioning apparatus 1. In FIG. 13, illustration of the supporting member 40 is omitted. The engagement between the first gear member 70 and the coupling member 90 will be described with reference to FIG. 13.

As described above with reference to FIG. 6, the engagement portion 76 having a wall shape is provided at the inner surface of the hollow cylindrical portion 71 of the first gear member 70, and the above first inclined surface 76A is formed at the upper end face of the engagement portion. That is, the engagement portion 76 has a substantially trapezoidal shape as viewed in front view. It should be noted that that another engagement portion 76 similar to the engagement portion 76 as illustrated in FIG. 13 is also provided opposite to the engagement portion 76 as illustrated in FIG. 13 with respect to the axis of the first gear member 70.

As described above with reference to FIG. 8, the second inclined surface 90A is formed at the lower end face of the coupling member 90. It should be noted that an inclined surface similar to the second inclined surface 90A as illustrated in FIG. 13 is also formed opposite to the second inclined surface 90A with respect to the axis of the coupling member 90.

The first inclined surface 76A of the engagement portion 76 of the first gear member 70 and the second inclined surface 90A of the lower portion of the coupling member 90 are formed in such a manner as to be inclined in the same direction and at the same angle. The first inclined surface 76A and the second inclined surface 90A are in contact with each other. As well as the inclined surfaces illustrated in FIG. 13, an inclined surface of the engagement portion of the first gear member 70, which is located opposite to the engagement portion 76 and the inclined surface of the coupling member 90, which is located opposite to the second inclined surface 90A are also formed in such a manner as to be inclined in the same direction and at the same angle, and are in contact with each other. Thus, when the first gear member 70 is rotated, the second inclined surface 90A and the first inclined surface 76A are kept in contact with each other, and the first gear member 70 and the coupling member 90 are rotated in synchronization with each other, if rotation of the coupling member 90 is not hindered. By contrast, even when the first gear member 70 is rotated, and if the rotation of the coupling member 90 is hindered, the second inclined surface 90A and the first inclined surface 76A are separated from each other from their contact state. As illustrated in FIG. 11, the flange 73 of the first gear member 70 is mounted at the first installation portion 22A of the lower base 22, and downward displacement of the cover assembly 202 is restricted as described above. Thus, when the rotation of the coupling member 90 is stopped and the second inclined surface 90A and the first inclined surface 76A are separated from each other from their contact state, the second inclined surface 90A slides diagonally upward relative to the first inclined surface 76A, As a result, the coupling member 90 moves upward. That is, the rotational force applied to the coupling member 90 is converted into a stress that displaces the coupling member 90 upward.

Figure 14:
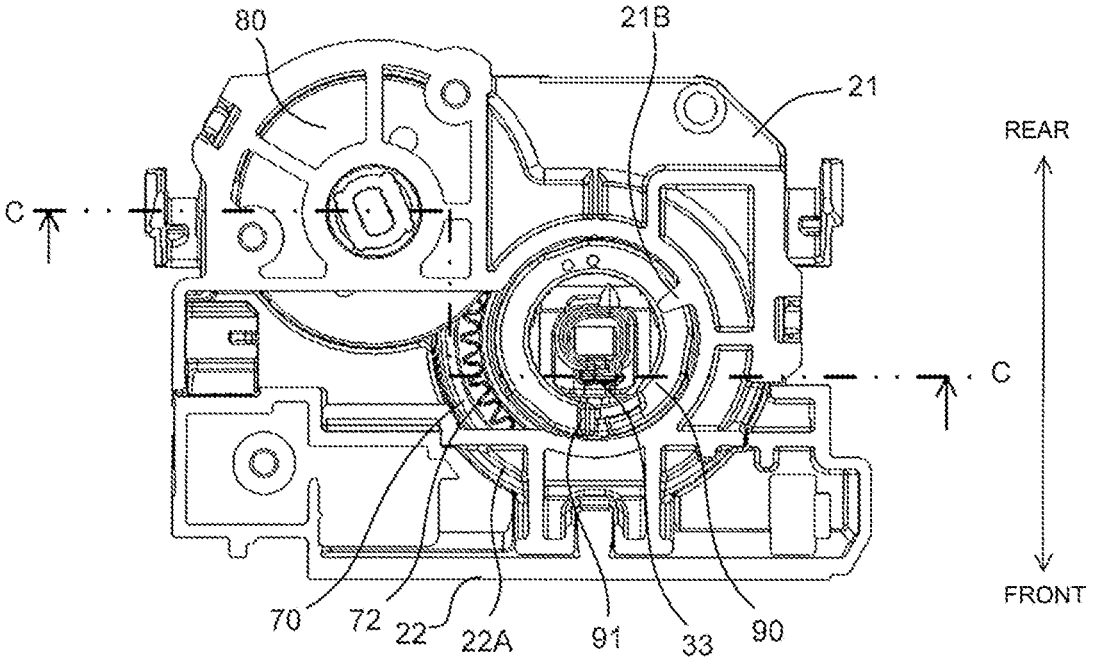
FIG. 14 is a plan view of the configuration of an upper portion of the heat-source detection unit of the air-conditioning apparatus according to Embodiment 1.

FIG. 14 is a plan view of a configuration of an upper portion of the heat-source detection unit of the air-conditioning apparatus according to Embodiment 1. FIG. 14 illustrates a state where the infrared sensor 33 faces the front of the air-conditioning apparatus 1. At the upper base 21, a stopper-reception portion 21B is provided in such a manner as to protrude toward the center of the first installation portion 22A of the lower base 22. The stopper-reception portion 21B is located at a right end portion of the air-conditioning apparatus 1 and closer to the rear of the air-conditioning apparatus 1 than to the front thereof. The coupling member 90 is attached such that the stopper 91 faces the front surface of the air-conditioning apparatus 1 when the infrared sensor 33 is located to face the front of the air-conditioning apparatus 1.

In Embodiment 1, the cover member 50, the sensor-supporting body 201, and the coupling member 90 are attached to be positioned as described below, when the infrared sensor 33 faces the front of the air-conditioning apparatus 1, It should be noted that in the following description, the position of the infrared sensor 33 where the infrared sensor 33 faces the front of the air-conditioning apparatus 1 is referred to as a reference position of the infrared sensor 33. When the infrared sensor 33 is located at the reference position, the cover member 50 as illustrated in FIG. 7 is attached such that the opening 56 faces the front of the air-conditioning apparatus 1. Thus, when being located at the reference position, the infrared sensor 33 can detect a heat source in the air-conditioned space through the opening 56 of the cover member 50. Also, the cover member 50 and the coupling member 90 are attached such that when the infrared sensor 33 is located at the reference position, the first inclined surface 76A of the engagement portion 76 of the hollow cylindrical portion 71 of the first gear member 70 and the second inclined surface 90A of the coupling member 90 are in contact with each other as illustrated FIG. 13. In addition, the coupling member 90 is attached such that when the infrared sensor 33 is located at the reference position, the stopper 91 of the coupling member 90 is located closer to the front of the air-conditioning apparatus 1 than to the rear thereof as illustrated in FIG. 14 and also located apart from the stopper-reception portion 21B of the upper base 21. Thus, when the rotational motion of the motor 60 is transmitted to the cover member 50 via the second gear member 80 and the first gear member 70, and the cover member 50 is rotated, the coupling member 90 is rotated along with the cover member 50.

Figure 15:
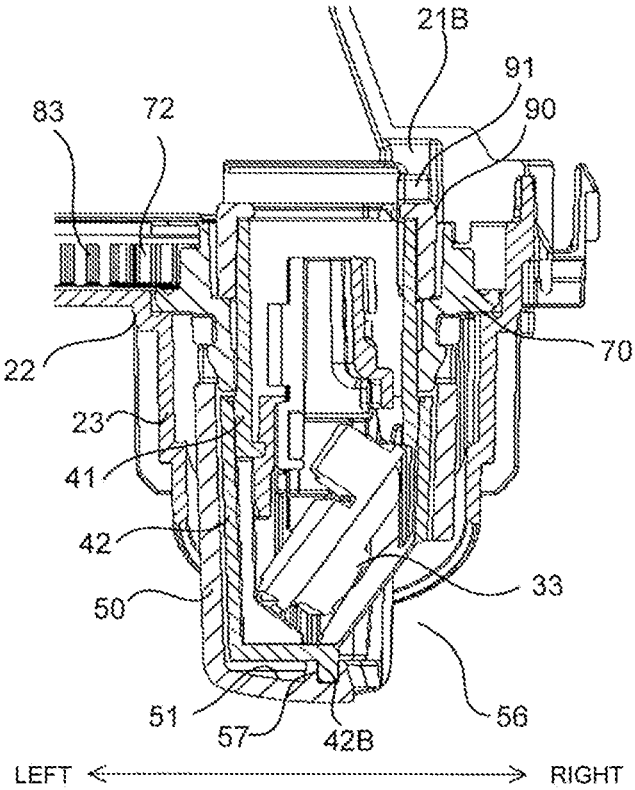
FIG. 15 is a sectional view of the sensor-supporting body and the cover assembly of the heat-source detection unit of the air-conditioning apparatus according to Embodiment 1.

FIG. 15 is a sectional view of the sensor-supporting body and the cover assembly of the heat-source detection unit of the air-conditioning apparatus according to Embodiment 1. FIG. 15 illustrates a state where the infrared sensor 33 faces the right of the air-conditioning apparatus 1. In the following description, a direction in which the infrared sensor 33 is rotated from a position where the infrared sensor 33 faces the front of the air-conditioning apparatus 1 to a position where the infrared sensor 33 faces the right of the air-conditioning apparatus 1 is referred to as a first direction; and a direction in which the infrared sensor 33 is rotated from the position where the infrared sensor 33 faces the right of the air-conditioning apparatus 1 to the position where the infrared sensor 33 faces the front of the air-conditioning apparatus 1, and a direction in which the infrared sensor 33 is rotated from the position where the infrared sensor 33 faces the front of the air-conditioning apparatus 1 to a position where the infrared sensor 33 faces the left of the air-conditioning apparatus 1 are each referred to as a second direction. That is, as the heat-source detection unit 20 is viewed from a side where the upper base 21 is located, the first direction is a counterclockwise direction, and the second direction is a clockwise direction. When the second gear member 80 is rotated in the second direction by the rotation of the motor 60, the first gear member 70 and the cover member 50 are rotated in the first direction, and the opening 56 of the cover member 50 is turned to the right of the air-conditioning apparatus 1.

At this time, as described above, the coupling member 90 is rotated along with the cover member 50, and the supporting member 40 having the upper frame 41 to which the coupling member 90 is attached is thus also rotated in synchronization with the cover member 50. That is, the supporting member 40 and the cover member 50 are rotated in the first direction, with the infrared sensor 33 positioned to face the opening 56 of the cover member 50. Then, as illustrated in FIG. 15, the opening 56 of the cover member 50 and the infrared sensor 33 are positioned to face the right of the air-conditioning apparatus 1.

Figure 16:
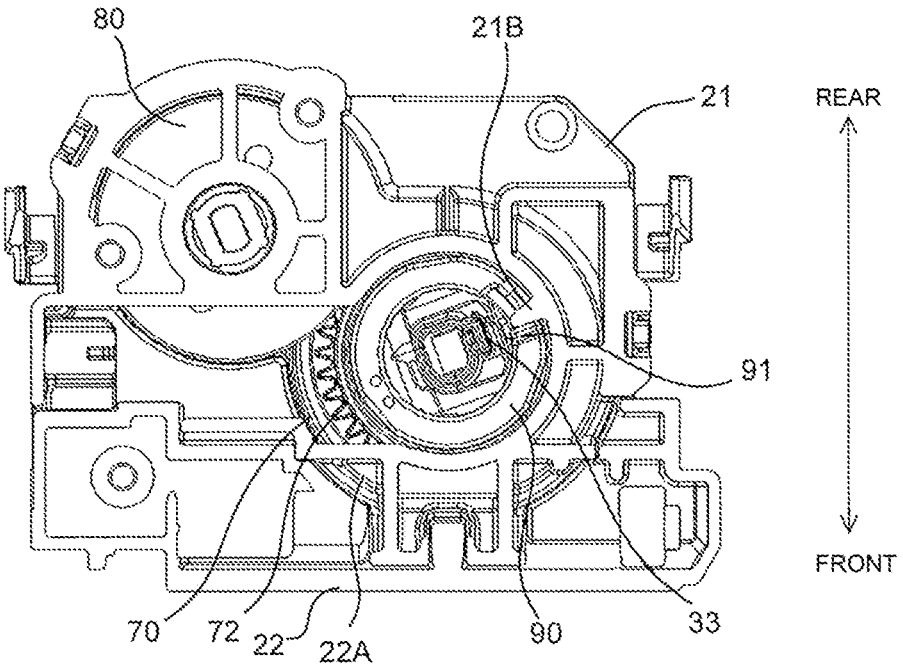
FIG. 16 is a plan view of the configuration of the upper portion of the heat-source detection unit of the air-conditioning apparatus according to Embodiment 1.
Figure 17:
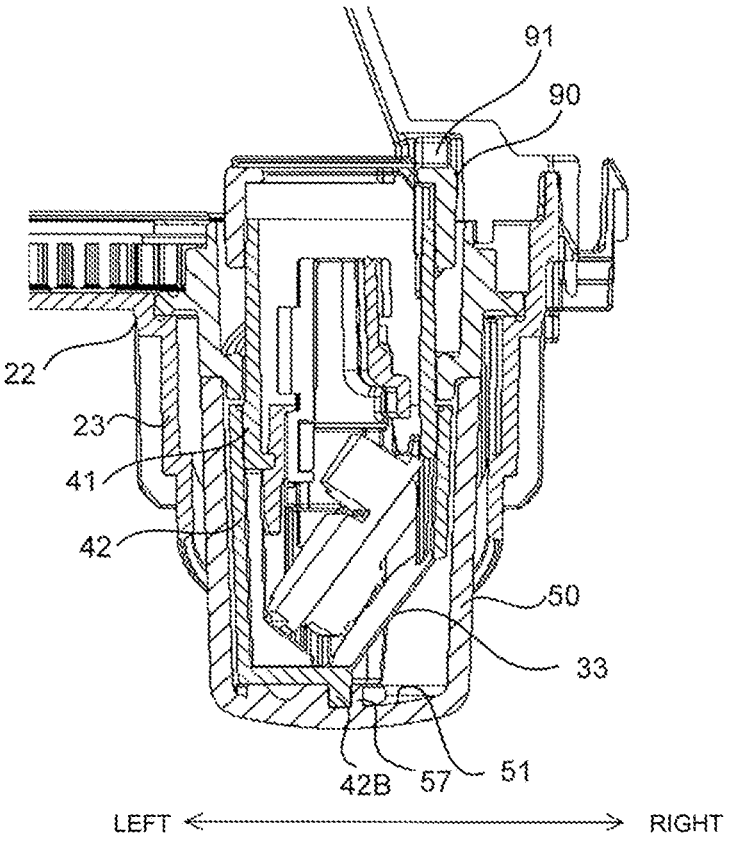
FIG. 17 is a sectional view of the sensor-supporting body and the cover assembly of the heat-source detection unit of the air-conditioning apparatus according to Embodiment 1.

FIG. 16 is a plan view of a configuration of the upper portion of the heat-source detection unit of the air-conditioning apparatus according to Embodiment 1. FIG. 17 is a sectional view of the sensor-supporting body and the cover assembly of the heat-source detection unit of the air-conditioning apparatus according to Embodiment 1. From the state illustrated in FIG. 14, when the first gear member 70 and the supporting member 40 are rotated in the first direction, the stopper 91 of the coupling member 90 is brought into contact with the stopper-reception portion 21B of the upper base 21 as illustrated in FIG. 16. In this state, when the first gear member 70 continues to be rotated, the cover member 50 is further rotated along with the first gear member 70 in the first direction. By contrast, the rotation of the coupling member 90 in the first direction is restricted by the stopper-reception portion 21B. In this state, when the rotational force in the first direction is applied to the coupling member 90, the second inclined surface 90A of the coupling member 90 and the first inclined surface 76A of the engagement portion 76 of the hollow cylindrical portion 71 of the first gear member 70 are separated from each other from their contact state illustrated in FIG. 13. Then, the second inclined surface 90A is slid relative to the first inclined surface 76A, and the coupling member 90 is moved upward. That is, the coupling member 90 and the first gear member 70 are disengaged from each other from their engagement state in which the coupling member 90 and the first gear member 70 are engaged with each other and which is maintained by the contact between the second inclined surface 90A and the first inclined surface 76A. Thus, only the first gear member 70 and the cover member 50 of the cover assembly 202 are rotated, and rotation of the sensor portion 30 and the supporting member 40 of the sensor-supporting body 201 is stopped. As a result, as illustrated in FIG. 17, the infrared sensor 33 is positioned to face a hollow cylindrical part of the cover member 50 where the opening 56 is not formed.

Figure 18:
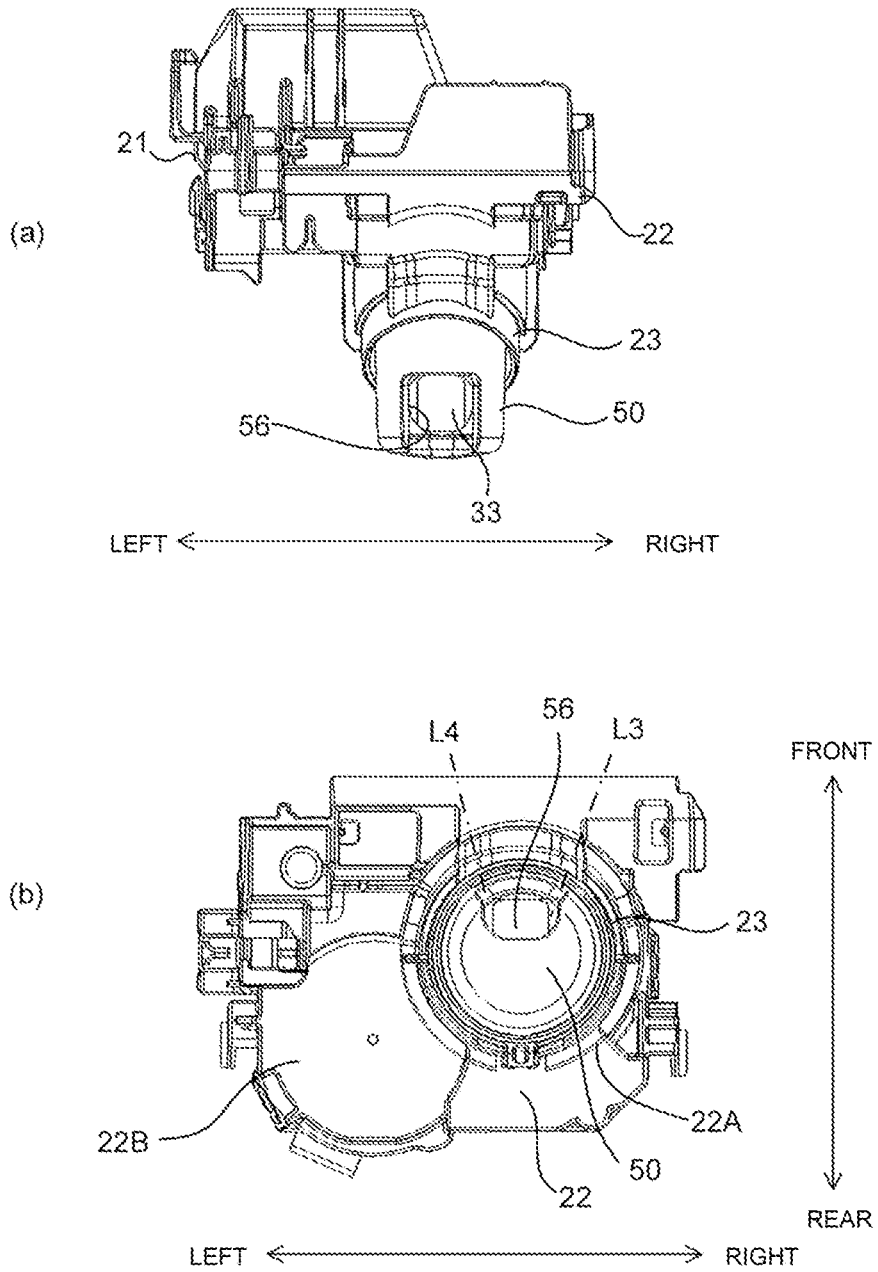
FIG. 18 illustrates displacement of the infrared sensor of the heat-source detection unit that is caused by rotation of a motor.
Figure 19:
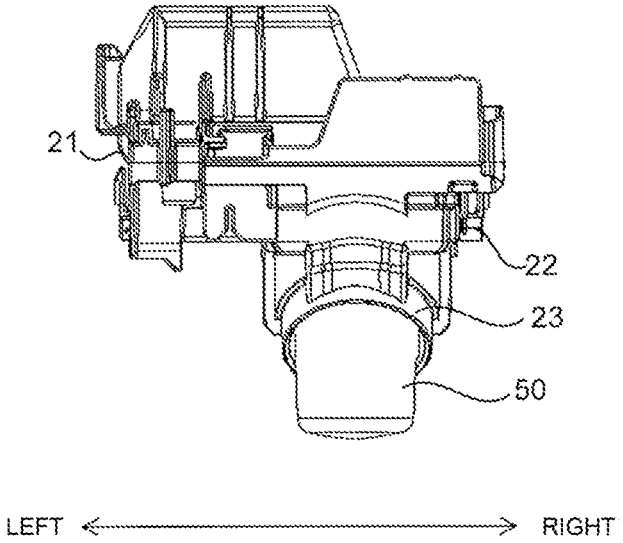
FIG. 19 illustrates displacement of the infrared sensor of the heat-source detection unit that is caused by the rotation of the motor.
Figure 19:
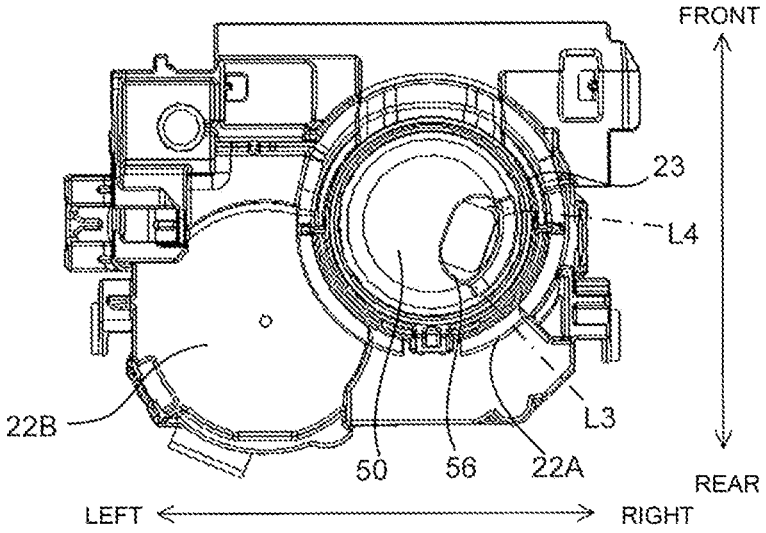
Figure 20:
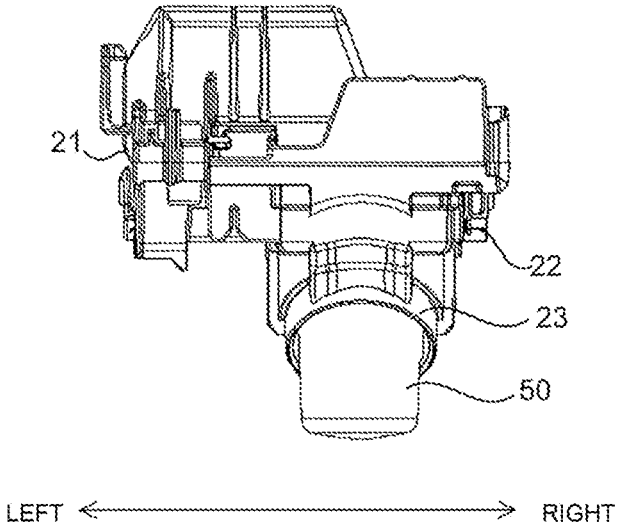
FIG. 20 illustrates displacement of the infrared sensor of the heat-source detection unit that is caused by the rotation of the motor.
Figure 20:
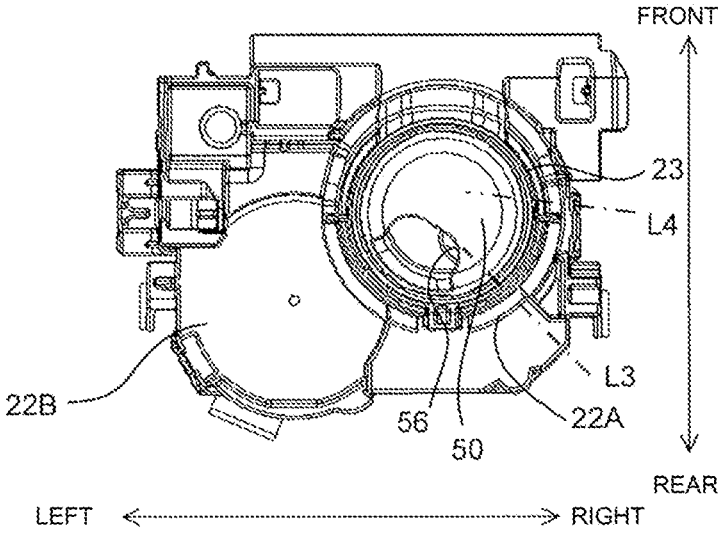

FIGS. 18 to 20 are views illustrating displacement of the infrared sensor of the heat-source detection unit that is caused by the rotation of the motor. In each of FIGS. 18 to 20, (a) illustrates the heat-source detection unit 20 as viewed in the direction toward the front of the air-conditioning apparatus 1, and (b) illustrates the heat-source detection unit 20 as viewed in a direction toward the bottom side of the lower base 22. In each of FIGS. 18 to 20, the angle between dot-and-dash line L3 and dot-and-dash line L4 is the viewing angle of the infrared sensor 33, as in FIG. 9. FIGS. 21 to 24 are schematic views each conceptually illustrating a relative positional relationship between the upper base, the coupling member, and the first gear member. Each of FIGS. 21 to 24 illustrates a bottom surface of the upper base 21, the coupling member 90, and the inner surface of the first gear member 70 such that the bottom surface of the upper base 21, the coupling member 90, and the inner surface of the first gear member 70 are developed on a plane. Here, the movement of each of the infrared sensor 33, the cover member 50, and the coupling member 90 that is made by the rotation of the motor 60 will be described with reference to FIGS. 18 to 20 and 21 to 24.

Figure 21:
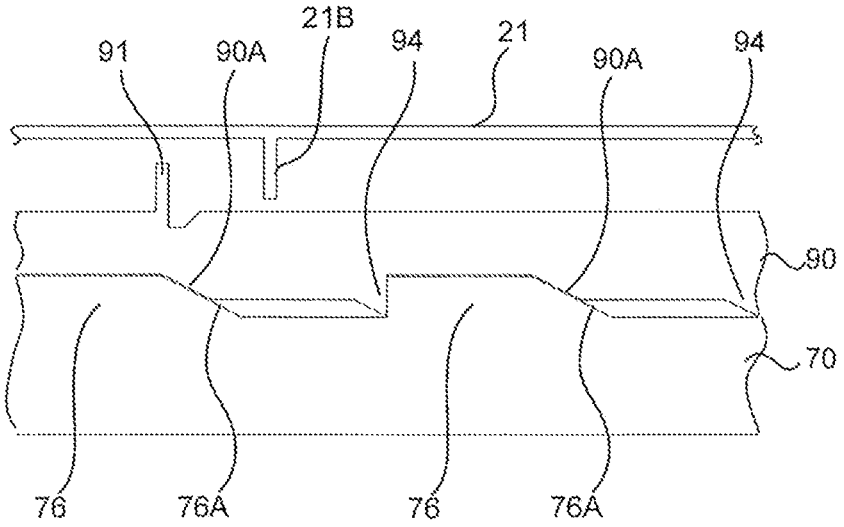
FIG. 21 is a diagram conceptually illustrating a relative positional relationship between an upper base, the coupling member, and the first gear member.
Figure 22:
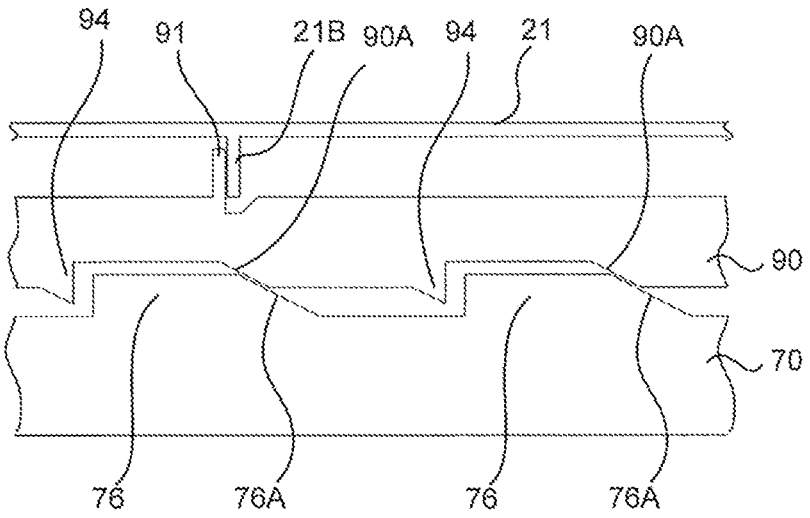
FIG. 22 is another diagram conceptually illustrating the relative positional relationship between the upper base, the coupling member, and the first gear member.

FIGS. 18 and 21 each illustrate a state where the infrared sensor 33 is located at the reference position. FIGS. 19 and 22 illustrate a state where the infrared sensor 33 is located at a position where rotation of the infrared sensor 33 is stopped. FIG. 20 illustrates a state where the infrared sensor 33 is at a position where the infrared sensor 33 is concealed. When the infrared sensor 33 is located at the reference position, the infrared sensor 33 and the opening 56 of the cover member 50 face the front of the air-conditioning apparatus 1. Part of the infrared sensor 33 that corresponds to the viewing angle thereof faces the front side of the air-conditioning apparatus 1 such that the above part of the infrared sensor 33 is not concealed by the cover member 50, that is, the above part faces a space to be subjected to the air-conditioning control. At this time, as illustrated in FIG. 21, the first inclined surface 76A of the engagement portion 76 of the first gear member 70 and the second inclined surface 90A of the coupling member 90 are in contact with each other. In addition, the stopper-reception portion 21B of the upper base 21 and the stopper 91 of the coupling member 90 are located apart from one another.

From the state illustrated in FIGS. 18 and 21, when the motor 60 is rotated, and the first gear member 70 is rotated in the first direction, the infrared sensor 33 and the cover member 50 are rotated, with the infrared sensor 33 positioned to face the opening 56 of the cover member 50. This state is maintained until the state illustrated in FIG. 19. That is, a state where the part of the infrared sensor 33 that corresponds to the field of view thereof is not concealed by the cover member 50 is maintained until the infrared sensor 33 is rotated from the reference position to a position where the rotation of the infrared sensor 33 is stopped. When the coupling member 90 is rotated to reach a position where the stopper 91 of the coupling member 90 is in contact with the stopper-reception portion 21B of the upper base 21, the infrared sensor 33 is located at the position where the rotation of the infrared sensor 33 is stopped.

Figure 23:
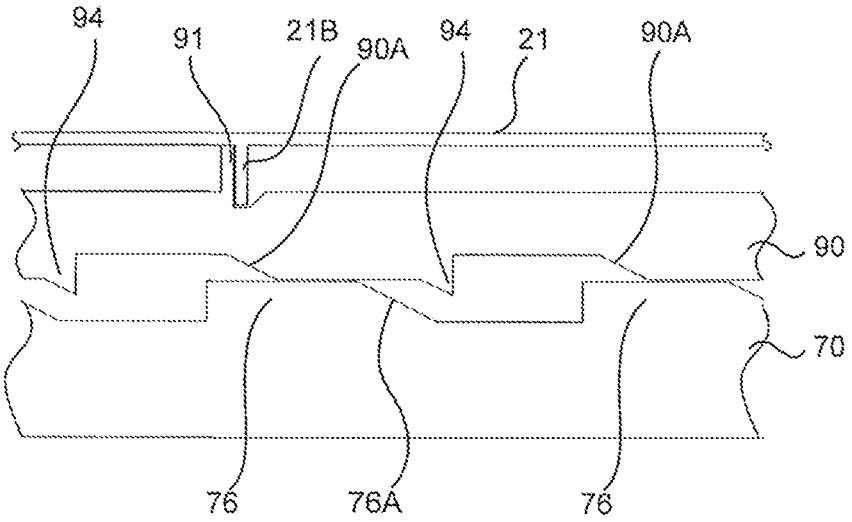
FIG. 23 is a still another diagram conceptually illustrating the relative positional relationship between the upper base, the coupling member, and the first gear member.

When the motor 60 is further rotated from the state illustrated in FIG. 19 and the first gear member 70 is further rotated in the first direction, the first inclined surface 76A of the engagement portion 76 of the first gear member 70 and the second inclined surface 90A of the lower portion of the coupling member 90 are separated from each other from their contact state illustrated in FIG. 22. As illustrated in FIG. 23, the coupling member 90 is then pushed upward. As a result, the rotation of the infrared sensor 33 is stopped, and only the cover member 50 continues rotating. Thus, as illustrated in FIG. 20, the part of the infrared sensor 33 that corresponds to the field of view thereof is concealed by the part of the cover member 50 in which the opening 56 is not formed.

When the motor 60 is rotated from the state illustrated in FIG. 20 in the opposite direction and the first gear member 70 is rotated in the second direction, only the cover member 50 is rotated in the second direction. At this time, the second inclined surface 90A of the lower portion of the coupling member 90 is guided by the first inclined surface 76A of the engagement portion 76 of the first gear member 70 to slide diagonally downward. As a result, the coupling member 90 is moved downward, and the second inclined surface 90A and the first inclined surface 76A are re-made to be in the state illustrated in FIG. 22. In addition, as illustrated in FIG. 19, the infrared sensor 33 is positioned to face the opening 56 of the cover member 50. When the motor 60 is further rotated in the opposite direction and the first gear member 70 is further rotated in the second direction, the infrared sensor 33 and the cover member 50 is rotated while the infrared sensor 33 is kept facing the opening 56 of the cover member 50. The infrared sensor 33 is then returned to the reference position indicated in FIGS. 18 and 21.

Figure 24:
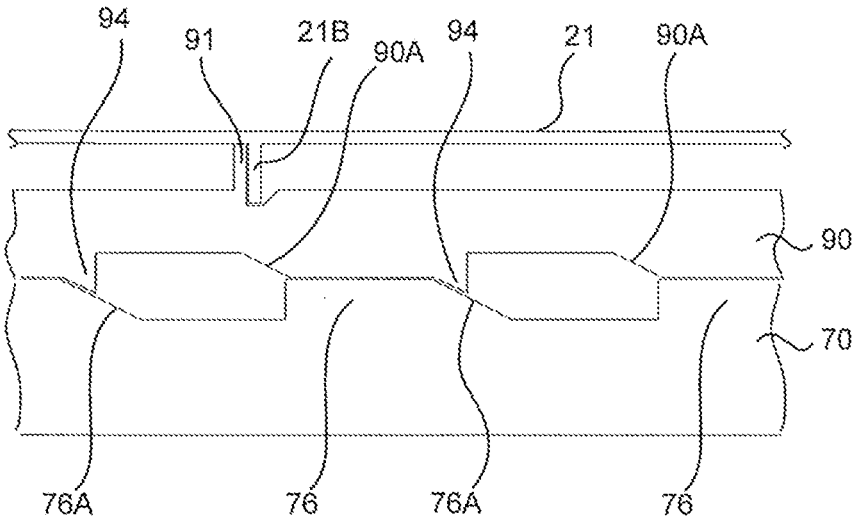
FIG. 24 is a further diagram conceptually illustrating the relative positional relationship between the upper base, the coupling member, and the first gear member.

It should be noted that when the motor 60 is rotated from the state illustrated in FIG. 23, and the first gear member 70 is further rotated in the first direction, the first inclined surface 76A of the first gear member 70 is brought into contact with the rotation-restricting protrusion 94 of the coupling member 90 as illustrated in FIG. 24. At this time, the stopper 91 of the coupling member 90 is in contact with the stopper-reception portion 21B of the upper base 21, and the rotation of the coupling member 90 in the first direction is thus restricted. Thus, the rotation of the first gear member 70 is restricted even if the motor 60 is rotated to further apply a rotational force in the first direction to the first gear member 70.

Figure 25:
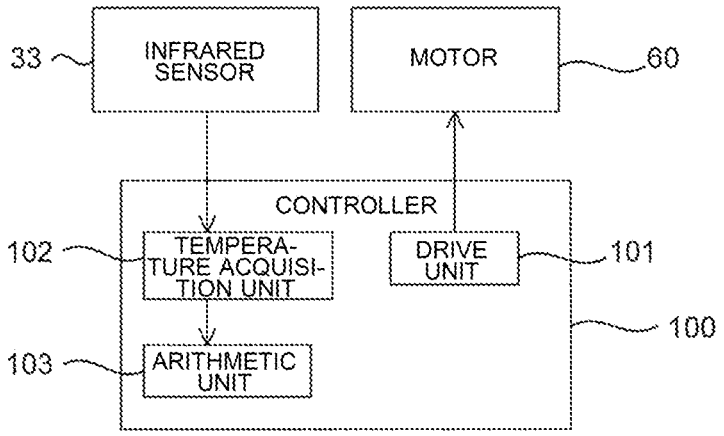
FIG. 25 is a functional block diagram of the air-conditioning apparatus according to Embodiment 1.

FIG. 25 is a functional block diagram of the air-conditioning apparatus according to Embodiment 1. A controller 100 is dedicated hardware or a central processing unit (CPU) that executes a program stored in a memory. It should be noted that the CPU is also referred to as a central processing device, a processing device, an arithmetic device, a microprocessor, a microcomputer, or a processor.

When the controller 100 is the dedicated hardware, the controller 100 is, for example, a single circuit, a composite circuit, an application specific integrated circuit (ASIC), a field-programmable gate array (FPGA), or a combination of these circuits. Function units that are implemented by the controller 100 may be implemented by respective hardware or single hardware.

When the controller 100 is the CPU, each of functions that are fulfilled by the controller 100 is fulfilled by software, firmware, or a combination of software and firmware. The software and the firmware are each described as a program and stored in the memory. The CPU reads a program stored in the memory and executes the read program, thereby fulfilling an associated each of functions of the controller 100. It should be noted that the memory is a nonvolatile or volatile semiconductor memory such as a RAM, a ROM, a flash memory, an EPROM, or an EEPROM.

Part of the functions of the controller 100 may be fulfilled by the dedicated hardware, and another part of the functions of the controller 100 may be fulfilled by one of software and firmware.

The controller 100 includes a drive unit 101, a temperature acquisition unit 102, and an arithmetic unit 103. The drive unit 101 outputs a control signal to the motor 60. The control signal output to the motor 60 indicates, for example, rotation, a rotational direction, and a stop of rotation. The motor 60 is driven based on the control signal output from the drive unit 101 to the motor 60. The infrared sensor 33 outputs a detection result to the temperature acquisition unit 102. The arithmetic unit 103 calculates the temperature of a heat source in the air-conditioned space based on the detection result output from the infrared sensor 33. Specifically, a temperature that is detected by the infrared sensor 33 when part of the infrared sensor 33 that corresponds to the field of view thereof is exposed, that is, when the above part is not concealed, is compensated for based on a temperature that is detected by the infrared sensor 33 when the part of the infrared sensor 33 that corresponds the field of view is concealed. That is, the temperature that is detected, with the infrared sensor 33 located to face the opening 56 of the cover member 50 is compensate for based on the temperature that is detected by the infrared sensor 33, with the infrared sensor 33 located to face the part of the cover member 50 that does not have the opening 56.

According to Embodiment 1, the infrared sensor 33 is positioned to face the opening 56 of the cover member 50 when facing the air-conditioned space. Thus, the infrared sensor 33 detects the temperature of a heat source in the air-conditioned space in a state in which the part of the infrared sensor 33 that corresponding to the field of view is not concealed. When not facing the air-conditioned space, the infrared sensor 33 is positioned to face the part of the cover member 50 in which the opening 56 is not formed, and the part of the infrared sensor 33 that corresponds to the field of view is concealed, Since the infrared sensor 33 detects a temperature in the above state, the temperature of heat generated by the infrared sensor 33 itself can be detected. It is therefore possible to accurately calculate the temperature of the air-conditioned space. Accordingly, even when a high-sensitive infrared sensor 33 that senses self-heating is used, it is possible to perform detection that takes advantage of the characteristics of the sensor. Thus, according to Embodiment 1, it is possible to improve the versatility of temperature detection by the air-conditioning apparatus 1.

Embodiment 2

Figure 26:
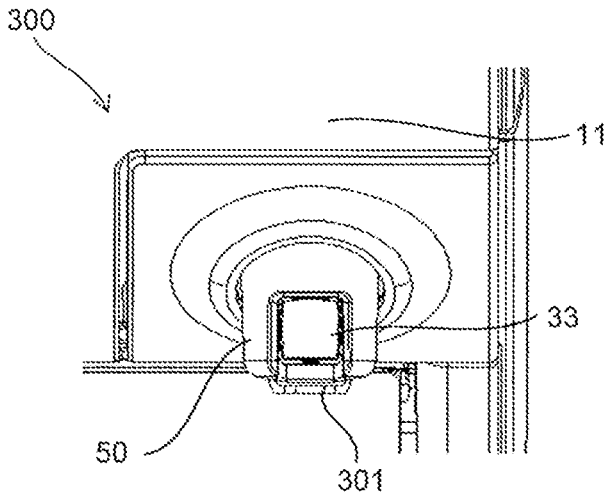
FIG. 26 is an enlarged view of part of the front of an air-conditioning apparatus according to Embodiment 2.

FIG. 26 is an enlarged view of part of the front of an air-conditioning apparatus according to Embodiment 2. In FIG. 26, components that are the same as those in Embodiment 1 that are described above with reference to FIGS. 1 to 20 are denoted by the same reference signs as in Embodiment 1. In addition, in the following description, the components that are denoted by the same references as in Embodiment 1 are also the same as those in Embodiment 1 that are described above with reference to FIGS. 1 to 20. Detailed descriptions of the same components as in Embodiment 1 will be omitted. FIG. 22 is an enlarged view of a right end portion of the front of an air-conditioning apparatus 300. In Embodiment 2, the heat-source detection unit 20 does not have the stopper-reception portion 21B of the upper base 21 that is described above regarding Embodiment 1, Thus, the infrared sensor 33 is rotated along with the cover member 50, with the infrared sensor 33 kept facing the opening 56 of the cover member 50.

The air-conditioning apparatus 300 includes a concealing portion 301. The concealing portion 301 has a plate shape and is made of material that does not allow infrared rays to pass therethrough. The concealing portion 301 is provided between the design panel 11 that forms part of the housing of the air-conditioning apparatus 300 and the heat-source detection unit 20.

Figure 27:
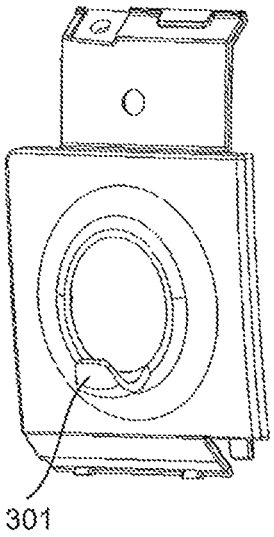
FIG. 27 is a perspective view of a concealing portion of the air-conditioning apparatus according to Embodiment 2 as viewed from below.

FIG. 27 is a perspective view of the concealing portion of the air-conditioning apparatus according to Embodiment 2 as viewed from below. In FIG. 23, illustration of the heat-source detection unit 20 is omitted. The concealing portion 301 is shaped in such a manner as to curve according to an outer circumferential surface of the cover member 50. When the cover member 50 is rotated from the position indicated in FIG. 22 and the infrared sensor 33 faces the rear side, the part of the infrared sensor 33 that corresponds to the field of view thereof is concealed by the concealing portion 301. When the infrared sensor 33 detects a temperature in this state, the temperature of heat that is generated by the infrared sensor 33 itself can be detected. It is therefore possible to obtain the same advantages as in Embodiment 1.

REFERENCE SIGNS LIST

1: air-conditioning apparatus, 10: rear case, 11: design panel, 12: air inlet, 13: air outlet, 14: heat exchanger, 15: fan, 16: electric component assembly, 17: drain pan, 18: wind-direction adjustment plate, 20: heat-source detection unit, 21: upper base, 21B: stopper-reception portion, 22: lower base, 22A: first installation portion, 22B: second installation portion, 220: protrusion, 23: sleeve, 24: screw, 25: screw, 30: sensor portion, 31: sensor substrate, 32: substrate holder, 33: infrared sensor, 40: supporting member, 41: upper frame, 41A: slit,

41B: slit, 42: lower frame, 42A: window, 42B: protrusion, 50: cover member, 51: bottom surface, 52: engagement slit, 53: engagement slit, 54: engagement hole, 55: engagement hole, 56: opening, 57: reception portion, 60: motor, 61: motor shaft, 70: first gear member, 71: hollow cylindrical portion, 72: spur gear portion, 73: flange, 74: linear protrusion, 75: rectangular protrusion, 76: engagement portion, 76A: first inclined surface, 80: second gear member, 81: upper bearing, 82: lower bearing, 83: spur gear portion, 90: coupling member, 90A: second inclined surface, 90B: flange, 91: stopper, 92: linear protrusion, 93: linear protrusion, 94: rotation-restricting protrusion, 100: controller, 101: drive unit, 102: temperature acquisition unit, 103: arithmetic unit, 201: sensor-supporting body, 202: cover assembly, 300: air-conditioning apparatus, 301: concealing portion

The invention claimed is:

1. An air-conditioning apparatus comprising a heat-source detection unit provided at a front of a housing, wherein the heat-source detection unit includes an infrared sensor configured to detect a heat source in an air-conditioned space, a supporting member that supports the infrared sensor, and a cover member that houses the infrared sensor and the supporting member, the cover member being made of material that does not allow infrared rays to pass therethrough, the cover member having an opening, wherein the supporting member and the cover member are configured to be rotated about an axis that extends in a vertical direction, and the infrared sensor is configured to be rotated about the axis that extends in the vertical direction, along with the supporting member, between a reference position where the infrared sensor faces a front of the air-conditioning apparatus and a rotation stop position where the infrared sensor does not face the air-conditioned space, when the infrared sensor is rotated in a first direction that is a direction from the reference position toward the rotation stop position, and the infrared sensor faces the air-conditioned space, and when the infrared sensor is rotated in a second direction that is a direction from the rotation stop position toward the reference position and that is the opposite direction to the first direction, and the infrared sensor faces the air-conditioned space, the supporting member and the cover member are rotated, with the infrared sensor located to face the opening, and when the cover member is further rotated from the rotation stop position in the first direction, and the infrared sensor does not face the air-conditioned space, and when the cover member is rotated toward the rotation stop position in the second direction, and the infrared sensor does not face the air-conditioned space, the infrared sensor is located to face part of the cover member in which the opening is not formed.

2. The air-conditioning apparatus of claim 1, wherein the heat-source detection unit includes a motor and a transmission unit configured to transmit rotation of the motor to the supporting member and the cover member, wherein each of the supporting member and the cover member has a hollow cylindrical shape, and the infrared sensor is provided in the supporting member and supported by the supporting member, wherein each of the supporting member and the cover member is configured to be rotatable about an axis, when the rotation of the motor is transmitted to the supporting member and the cover member by the transmission unit, wherein the transmission unit includes a first gear member attached to the cover member, a second gear member attached to a motor shaft of the motor and engaged with the first gear member, and a coupling member coupled to the supporting member, and wherein the coupling member is configured to:

transmit rotation of the first gear member to the supporting member, when the infrared sensor faces the air-conditioned space and is positioned to face the opening of the cover member, and cause the supporting member to stop independent of rotation of the first gear member, when the infrared sensor does not face the air-conditioned space.

3. The air-conditioning apparatus of claim 2, wherein the first gear member includes a hollow cylindrical portion, a spur gear portion formed at an outer surface of the hollow cylindrical portion, and an engagement portion formed at an inner surface of the hollow cylindrical portion, the engagement portion having an upper end face at which a first inclined surface is formed, the first inclined surface being inclined in the vertical direction, wherein the coupling member has a hollow cylindrical shape and has a lower end face at which a second inclined surface is formed, the second inclined surface being inclined in the vertical direction, wherein the supporting member is inserted into the hollow cylindrical portion of the first gear member from below, wherein the coupling member is provided between the supporting member and the hollow cylindrical portion of the first gear member, and is configured to transmit rotation of the first gear member to the supporting member, with the second inclined surface being in contact with the first inclined surface, when the infrared sensor faces the air-conditioned space and is positioned to face the opening of the cover member, and wherein when the supporting member is rotated in the first direction to reach a position where the air-conditioned space is out of a field of view of the infrared sensor, rotation of the coupling member is stopped, and when the supporting member is further rotated in the first direction, the second inclined surface is slid over the first inclined surface and the second inclined surface and the first inclined surface are separated from each other from a contact state between the second inclined surface and the first inclined surface.

4. The air-conditioning apparatus of claim 2, further comprising:

an upper base that supports the motor; and a lower base that is provided below the upper base and at which the cover member and the supporting member are provided, wherein at an upper end face of the coupling member, a stopper is provided to protrude upward, wherein at a lower surface of the upper base, a stopper-reception portion is provided, and wherein when the supporting member is rotated in the first direction to reach a position where the air-conditioned space is out of a field of view of the infrared sensor, the stopper is brought into contact with the stopper-reception portion, thereby stopping the rotation of the coupling member in the first direction.

5. The air-conditioning apparatus of claim 1, further comprising a controller configured to determine a temperature of the air-conditioned space based on a result of detection by the infrared sensor, wherein the controller is configured to compensate for a temperature that is detected by the infrared sensor when part of the infrared sensor that corresponds to a field of view thereof is exposed, based on a temperature that is detected by the infrared sensor when the part of the infrared sensor is concealed.

* * * * *